US005786011A

United States Patent [19]

Desjardins

[11] Patent Number: 5,786,011

[45] Date of Patent: Jul. 28, 1998

[54] PACKAGED FOOD PRODUCT AND PACKAGE

[76] Inventor: Andre Desjardins, 184, Desjardins, Magog (QC), Canada, J1X 5X3

[21] Appl. No.: 781,006

[22] Filed: Jan. 9, 1997

[51] Int. Cl.[6] ..... B65D 85/00

[52] U.S. Cl. ..... 426/119; 426/106; 426/115; 426/122; 206/545; 220/266

[58] Field of Search ..... 426/115, 199, 426/106, 122, 130, 128, 120; 206/523, 545; 220/265, 266, 270, 276

[56] References Cited

U.S. PATENT DOCUMENTS 2,703,287 3/1955 Peters ..... 426/115

3,414,414 12/1968 Christine et al. ..... 426/122

3,529,761 9/1970 Dogliotti ..... 426/106

*Primary Examiner*—Lien Tran

[57] ABSTRACT

A food product container having a body which comprises a central section, peripheral sections and, individual cavities to contain small portions of food product. Each cavity of the body overlaps the central section and one of the peripheral sections which are linked via a weakening line permitting detachment of the two sections. This detachment allows for the removal of a food portion in the cavity without altering the food portion in the adjacent cavities. The geometrical shape of the cavity makes it easy to remove the food product from the container especially when the weakening line is located at the maximal width of the geometrical shape.

15 Claims, 2 Drawing Sheets

PACKAGED FOOD PRODUCT AND PACKAGE

FIELD OF INVENTION

This invention relates to containers, more specifically to food product containers and to the food product formed thereby.

PRIOR ART

Prepared food products, and particularly desserts which are frozen or refrigerated, are well known in the art, especially by consumers and commercial establishments such as restaurants. From the time of their preparation, these food products undergo many stages of processing and handling. These stages include placing the food in a mold so that it sets and which setting may occur as a result of chemical reactions such as with gelatin or may be temperature dependent such as mousses and dairy products such as ice cream. The food product, once set, is taken from the mold to be further enhanced to form the final product. The product is then packaged for distribution. All these stages increase the risk of contamination of the food product not to mention the costs incurred through each stage of the process.

In order to reduce the cost of preparation and handling, it is preferable to sell these food products either in large quantities of small portions or in bulk.

For small families, single people or commercial establishments such as restaurants it is not advantageous to have to open large portions of said food product without being certain that they can all be consumed before deterioration sets in once the container is opened.

SUMMARY OF THE INVENTION

It is an object of the present invention to provide various small individual portions of food product in a single container in a way which will be cost effective.

It is a further object to provide a food product wherein each individual portion is independently accessible to allow for the preservation of the remaining portions which remain sealed.

It is a further object of the present invention to provide a food product in which the container serves firstly as a production mold and at the same time is the container for the end product.

According to one aspect of the present invention, there is provided a container for a food product the container having a body portion, the body portion comprising:

a central section;

a plurality of peripheral sections linked to the central section by weakening means allowing for an easy detachment of the peripheral sections from the central section;

a plurality of cavities overlapping the central section and each one of the peripheral section. Each of these cavities, defined by a wall and a bottom, is designed to accommodate one portion of a food product. The cavity is of a desired geometrical shape and is divided in two parts by a weakening means (line of weakening) which allows for easy removal of the food product from the container after the detachment of the peripheral section. The walls of the cavities located in the peripheral sections separate the cavities from exterior of the body.

The weakening means of this invention may conveniently be a groove or slit formed in the body at the bottom of one of the cavities and slits in the walls of the cavities, the slits being coplanar to the groove, the weakening means each forming a plane separating one of the peripheral sections from the central section, each plane being perpendicular to the bottom of one of the cavities. The groove can also be a V-shaped groove in order to prevent any damage to the food product during the detachment.

The geometrical shape of each of the container cavities of the present invention can have their maximal width just at the weakening means location, where they are divided into two parts, the maximal width would coincide to the plane formed by the weakening means.

The container of the present invention can also include a lid which totally covers the body thus closing the cavities and which is attached to the body by an attaching means which permits the removal of the lid before detaching the peripheral sections from the central section. It can also contain a plurality of a retaining means to keep peripheral sections from falling after detachment and to allow a repositioning of the peripheral sections in place in order to ensure extended preservation of the food products back into the cavities formed thereby after putting back the lid onto the body. Each holding means can preferably be made out of adhesive tape bonded to both the central section and one of the peripheral sections, onto the side opposite to the lid thus acting as a hinge between the two sections.

According to a further aspect of the present invention, the body can act as a mold permitting the setting of a food product, the food product being flowable in nature and inclined to set. Therefrom the container serves as packaging as well as a mold for the preparation of the food product.

The material forming the container/mold is thermally insulating material such as a closed cell food grade foam material. Such materials are well known in the art and readily available and thus need not be discussed herein.

According to a further aspect of the present invention, there is provided a packaged food product comprising a container, and a plurality of food products, the container comprises a body having a plurality of cavities each defined by walls and a bottom. The body comprises a central section and a plurality of peripheral sections. The peripheral sections are attached to the central section by weakening means which allow for an easy detachment of the peripheral sections from the central section. Each cavity overlaps the central section and one of the peripheral sections and has a geometrical shape divided into two parts by the weakening means. Each cavity contains a food product. The weakening means also allows for an easy removal of the food product from the container after detachment of the peripheral section. The walls of the cavities located in the peripheral sections separate the cavities from the exterior of the body.

Having thus generally described the invention, reference will be made to the accompanying drawings illustrating an embodiment thereof:

PREFERRED EMBODIMENTS OF THE INVENTION

Figure 1:
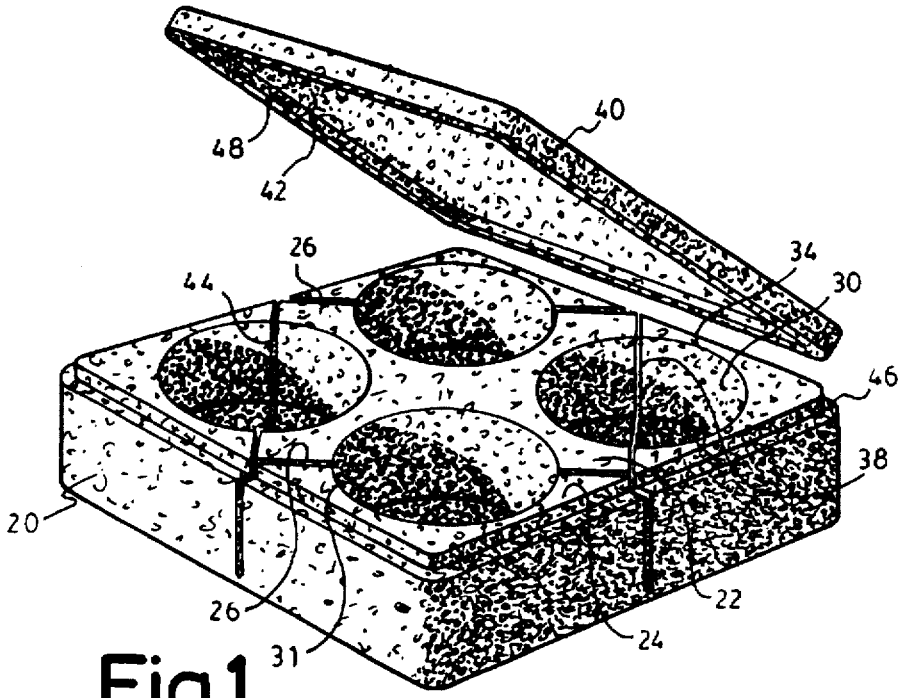
FIG. 1 is a view in perspective of a food product container.

A preferred embodiment of the present invention is illustrated in FIG. 1 whereas the same characteristic elements are identified by the same corresponding numbers:

A body 20 made of food grade material, preferably closed cell food grade foam, and being rectangular in shape, has four cavities 30. The body 20 is composed of a central section 22 and four, peripheral sections 24. The peripheral sections 24 are located at the periphery of the body 20. The peripheral sections 24 are divided from the central section 22 by a line of weakening 26 allowing for easy detachment of the peripheral sections 24 from the central section 22. Each peripheral section 24 has a grip means 28 for fingers, preferably on one side of the peripheral section 24 on top of the body 20, being as far away as possible from the central section 22 to allow for the best leverage, and offer the best grip of the peripheral section 24 for the detachment from the central section 22.

A lid 40 covers the body portion 20 and is attached to the body 20 by an attachment means 42. The attachment means is, preferably via a counterbore 46 encircling the periphery of the body 20, into which engages a lip flange 48 which completely surrounds the periphery of the lid 40.

Figure 2:
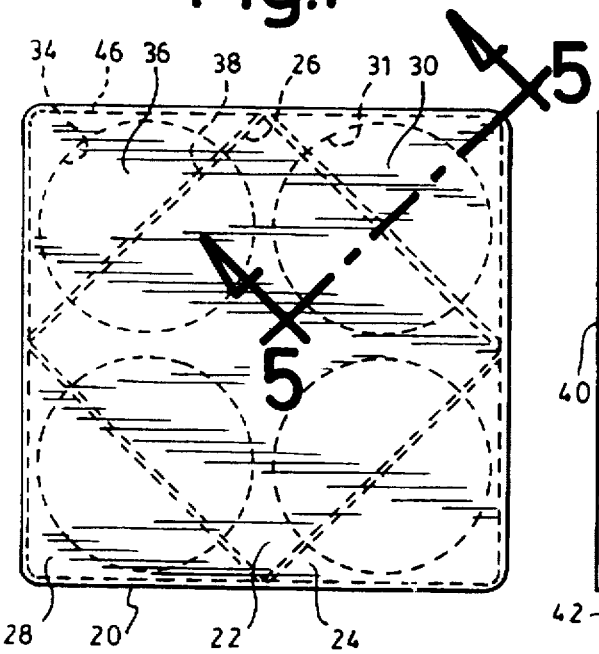
FIG. 2 is a plan view of a food product container.

FIG. 2 shows, according to a further embodiment of the invention, that each cavity 30 overlaps the central section 22 and one of the peripheral sections 24. The cavities 30 are comprised of walls 34 attached to a bottom 36. The walls of the cavities 30 located in the peripheral sections 24 separate the cavities 24 from the exterior of the body 20. The line of weakening 26 are preferably grooves inscribed in the body at the bottom 36 of the cavities 30 (see FIG. 5) and slits 44 inscribed in the body 20 at wall level 34. The grooves 38 and the slits 44 forming a plane which separates the central section 22 from one of the peripheral sections 24, and is perpendicular to the bottom 36 of the cavity 30. This weakening means 26 divides the geometrical shape 31 of the cavity 30 into two parts. This separation is preferably located at a level coinciding with the maximal width of the geometrical shape 31 of the cavity 30, so as to permit easy removal of the food product 32 from its cavity 30. This embodiment of FIG. 2 shows the lip flange 48 which completely surrounds the periphery of the lid 40 preferably engaging directly to the periphery of the body 20, as also shown in FIG. 4.

Figure 3:
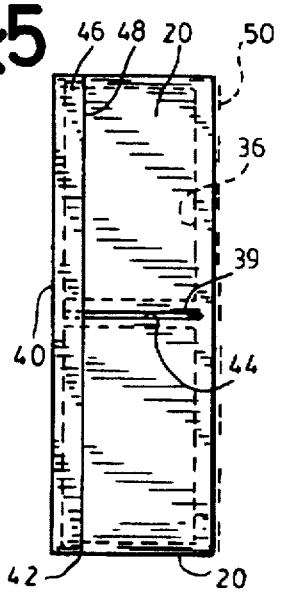
FIG. 3 is side view of a food product container.
Figure 6:
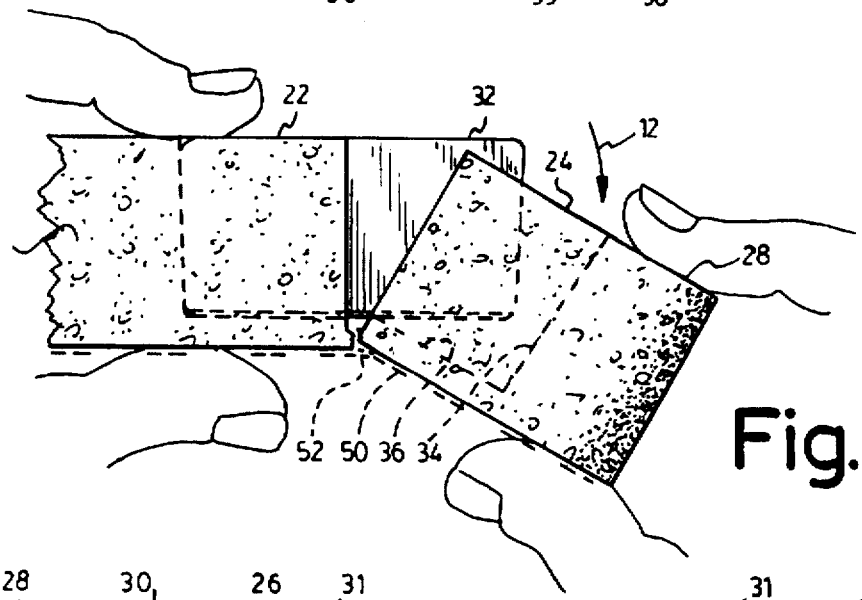
FIG. 6 is a similar view as in FIG. 5 and illustrating the removal of the food product.

In FIG. 3, one may see retaining means 50 bonded onto the side of the body 20 opposite to the lid 40. These retaining means 50, preferably of adhesive tape, form hinges 52 which keep for the peripheral sections 24 from falling of the central section 22 after detachment 12 illustrated in FIG. 6, in a way which insures extended preservation of the food product 32 in the cavities 30 and as well allows for the putting back of the lid 40 on the body 20 by the attachment means 42.

Figure 4:
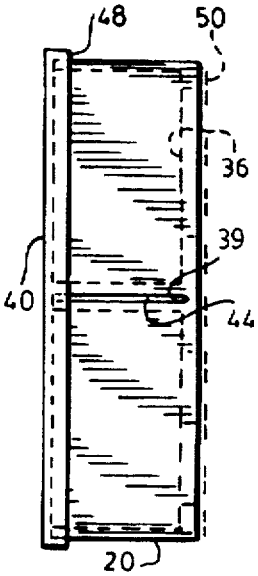
FIG. 4 is side view of another food product container showing a different embodiment with respect to the lid.

FIG. 4 shows a different embodiment with respect to the attachment means 42 where the lid 40 has a perimeter slightly larger than that of the body 20, and as such, the lip flange 48 encases the body 20 without the need of a counterbore 46.

Figure 5:
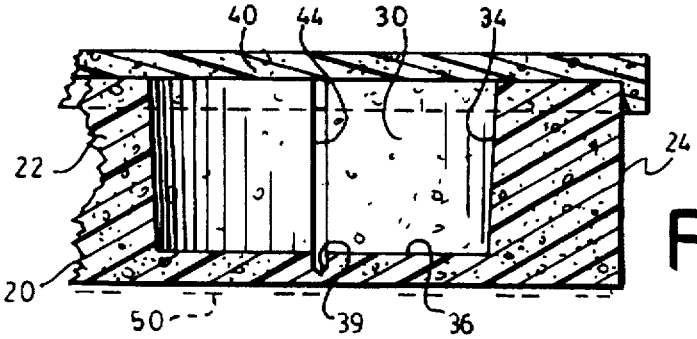
FIG. 5 is a view along line 5—5 of FIG. 2

In FIG. 5 it will be noted that the walls 34 of the cavity 30 are slightly inclined in a way which limits the geometrical shape 31 of the cavity 30 towards the bottom 36, to aid in the removal of the food product from the container, after the detachment 12 of the peripheral section 24 from the central section 22. The grooves 38 are preferably V-shaped grooves 39, so as to avoid any damage to the food product 32 in the process of detachment 12.

Figure 7:
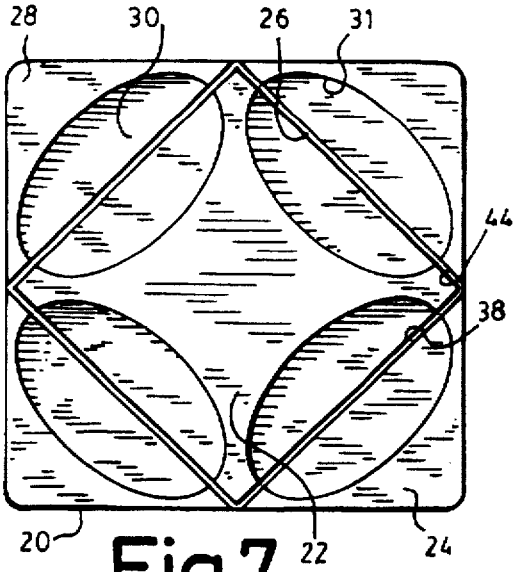
FIGS. 7 and 8 are plan views of other food product container showing a different embodiment with respect to the geometrical shape of the cavities.
Figure 8:
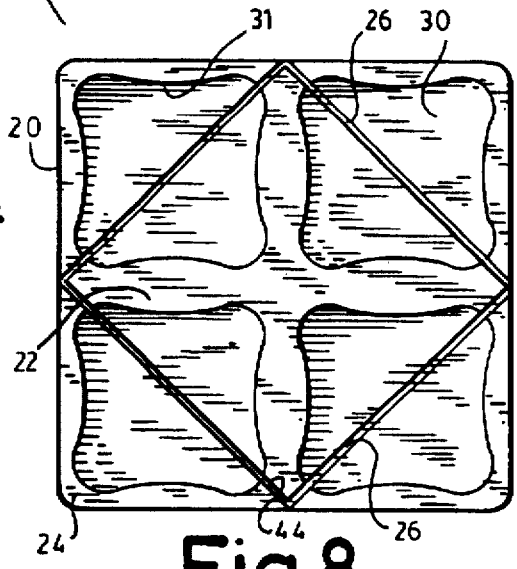

The cavities 30 can take a plurality of geometrical shapes 31 as illustrates in FIG. 7 and 8. Circular forms 31 are preferred.

It will be understood that the above described embodiment is for the purpose of illustration only and that changes and modifications may be made thereto without departing from the spirit and scope of the invention.

I claim:

1. A container for a food product comprising a body portion having a plurality of cavities formed therein, each cavity being defined by a side wall and a bottom wall, said body portion comprising a central section and a plurality of peripheral sections, lines of weakening being formed in said body portion to thereby divide said central section from said peripheral sections, said lines of weakening allowing an easy detachment of each of said peripheral sections from said central section, each of said cavities overlapping said central section and one of said peripheral sections and having a geometrical shape divided into two parts by said lines of weakening, said lines of weakening allowing for an easy removal of said food product from said cavity after detachment of a peripheral section.

2. A container as in claim 1 wherein each of said lines of weakening comprises a side wall slit portion and a coplanar bottom wall slit portion, said side wall slit portion extending from an upper peripheral margin of said cavity side wall to said bottom wall slit portion.

3. Container as in claim 2 wherein said bottom wall slit portion comprises a V-shaped groove.

4. Container as in claim 3 wherein said geometrical shape of each of said cavities has a maximal width whereby said geometrical shape is divided into said two parts by said line of weakening, said maximal width coinciding to a plane defined by said line of weakening.

5. Container as in claim 3 further comprising:

a lid covering said body and said cavities, attachment means for attaching said lid to said body, said attachment means being releasable to allow removal of said lid from said body a plurality of retaining means keeping said peripheral sections from fully separating from said central section and allowing for repositioning of said peripheral sections against said central section.

6. Container as in claim 5 wherein said retaining means being adhesive tapes linking said peripheral sections to said central section, said adhesive tapes being bonded to both said central section and said peripheral sections on a side opposite to said lid thus acting as a hinge between said two sections.

7. Container as in claim 2 and further comprising a grip means on each one of said peripheral sections, said grip means allowing for a better grip of said peripheral section during said detachment of said peripheral section.

8. Container as in claim 2 wherein said side wall is slightly inclined inwardly thereby narrowing said geometrical shapes toward said bottom wall and allowing for easier removal of said food products from said container after said detachments.

9. Container as in claim 2 wherein said body being made out of a food grade plastic material.

10. Container as in claim 9 wherein said plastic material is a closed cell food grade foam material.

11. Container as in claim 2 wherein said body comprises a mold allowing said food products to set, said food products being flowable settable food products.

12. A food package comprising a container and a plurality of food products, said container comprising a body portion having a plurality of cavities formed therein, each cavity being defined by a side wall and a bottom wall, said body portion comprising a central section and a plurality of peripheral sections, lines of weakening being formed in said body portion to thereby divide said central section from said peripheral sections, said lines of weakening allowing an easy detachment of each of said peripheral sections from said central section, each of said cavities overlapping said central section and one of said peripheral sections and having a geometrical shape divided into two parts by said lines of weakening in each of said cavities containing one of said food products, said lines of weakening allowing an easy removal of said food product from said cavity after detachment of a peripheral section.

13. A food package as in claim 12 wherein each of said lines of weakening comprises a side wall slit portion and a coplanar bottom wall slit portions, said side wall slit portion extending from an upper peripheral margin of said cavity side wall to said bottom wall slit portion.

14. A food package as in claim 13 and further comprising:

a lid covering said body and said cavities, attachment means for attaching said lid to said body, said attachment means being releasable to allow removal of said lid from said body a plurality of retaining means keeping said peripheral sections from fully separating from said central section and allowing for repositioning of said peripheral sections against said central section.

15. A food product as in claim 14 wherein said retaining means being adhesive tapes linking said peripheral sections to said central section, said adhesive tapes being bonded to both said central section and said peripheral sections on a side opposite to said lid thus acting as a hinge between said two sections.

* * * * *